US010283912B2

(12) United States Patent
Gao et al.

(10) Patent No.: US 10,283,912 B2
(45) Date of Patent: May 7, 2019

(54) CONNECTOR AND CONNECTOR ASSEMBLY RESISTANT TO VIBRATION

(71) Applicant: Tyco Electronics (Shanghai) Co. Ltd., Shanghai (CN)

(72) Inventors: Bo Gao, Shanghai (CN); Hao Wang, Shanghai (CN); Biao Pan, Shanghai (CN); Jiefeng Zhang, Shanghai (CN); Ning Wang, Shanghai (CN); Jianfei Yu, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 15/793,074

(22) Filed: Oct. 25, 2017

(65) Prior Publication Data

US 2018/0115111 A1 Apr. 26, 2018

(30) Foreign Application Priority Data

Oct. 25, 2016 (CN) ..... 2016 2 1148187 U

(51) Int. Cl.

| | |
|---|---|
| ***H01R 13/648*** | (2006.01) |
| ***H01R 4/30*** | (2006.01) |
| ***H01R 4/48*** | (2006.01) |
| ***H01R 9/05*** | (2006.01) |
| *H01R 103/00* | (2006.01) |
| *H01R 13/627* | (2006.01) |
| *H01R 24/40* | (2011.01) |

(52) U.S. Cl.

CPC ..... *H01R 13/648* (2013.01); *H01R 4/30* (2013.01); *H01R 4/4863* (2013.01); *H01R 9/0527* (2013.01); *H01R 13/6277* (2013.01); *H01R 24/40* (2013.01); *H01R 2103/00* (2013.01)

(58) Field of Classification Search

CPC ..... H01R 13/648; H01R 4/30; H01R 4/4863
USPC ..... 439/607.01, 578, 382
See application file for complete search history.

(56) References Cited

U.S. PATENT DOCUMENTS

| | | | | |
|---|---|---|---|---|
| 3,953,098 | A * | 4/1976 | Avery | H01R 13/635 439/258 |
| 3,976,352 | A * | 8/1976 | Spinner | H01R 24/40 333/260 |
| 4,017,139 | A * | 4/1977 | Nelson | F16L 37/133 285/316 |
| 4,746,305 | A * | 5/1988 | Nomura | H01R 13/625 439/319 |
| 5,637,010 | A * | 6/1997 | Jost | H01R 13/6277 439/352 |
| 6,464,526 | B1 * | 10/2002 | Seufert | H01R 13/6273 439/352 |
| 6,942,516 | B2 * | 9/2005 | Shimoyama | H01R 13/6272 439/352 |
| 9,570,853 | B1 * | 2/2017 | Yu | H01R 13/639 |

(Continued)

*Primary Examiner* — Hae Moon Hyeon
(74) *Attorney, Agent, or Firm* — Barley Snyder

(57) ABSTRACT

A connector comprises a body, a shield housing fitted over the body, and a spring disposed within the shield housing and fitted over the body. The body has a first positioning structure formed on an outer wall of the body. The shield housing has a second positioning structure formed on an inner wall of the shield housing. The spring has a first end abutting against the second positioning structure and an opposite second end abutting against the first positioning structure.

13 Claims, 6 Drawing Sheets

(56) References Cited

U.S. PATENT DOCUMENTS

| | | | | |
|---|---|---|---|---|
| 2010/0255721 | A1* | 10/2010 | Purdy | H01R 9/0521<br>439/583 |
| 2014/0315448 | A1* | 10/2014 | Phillips, Jr. | H01R 9/0524<br>439/805 |
| 2015/0187465 | A1* | 7/2015 | McErlean | H01R 13/005<br>174/28 |

* cited by examiner

CONNECTOR AND CONNECTOR ASSEMBLY RESISTANT TO VIBRATION

CROSS-REFERENCE TO RELATED APPLICATION

This application claims the benefit of the filing date under 35 U.S.C. § 119(a)-(d) of Chinese Patent Application No. 201621148187.0, filed on Oct. 25, 2016.

FIELD OF THE INVENTION

The present invention relates to a connector and, more particularly, to a connector resistant to vibration.

BACKGROUND

A cylindrical electrical connector known in the art includes an insulation body, a conductive terminal disposed in the insulation body, and a metal shield housing fitted over the insulation body. The shield housing is commonly formed by stamping a single metal sheet and is substantially rigid.

An external axial impact force acting on the metal shield housing is immediately and directly transferred to the insulation body, causing damage to the insulation body since the insulation body is usually made of plastic with a lower strength. The known cylindrical connector is thus easily damaged when under axial vibration. Furthermore, the known cylindrical connector is not capable of providing effective electromagnetic shielding to a wire connected to the cylindrical connector.

SUMMARY

A connector according to the invention comprises a shield housing with a positioning structure formed on an inner wall of the shield housing. A body is fitted under the shield housing and has a positioning structure formed on an outer wall. A spring is disposed within the shield housing and is fitted over the body. A first end of the spring is abutted against the positioning structure of the body and an opposite second end abuts against the positioning structure of the shield housing.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
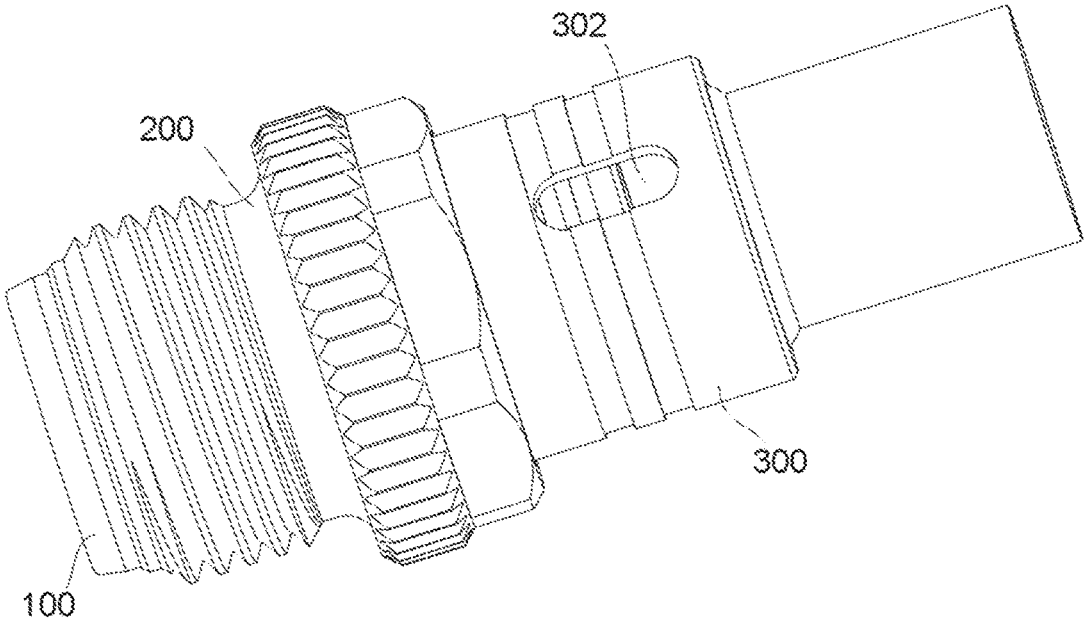
FIG. 1 is a perspective view of a connector according to an embodiment.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

Figure 2:
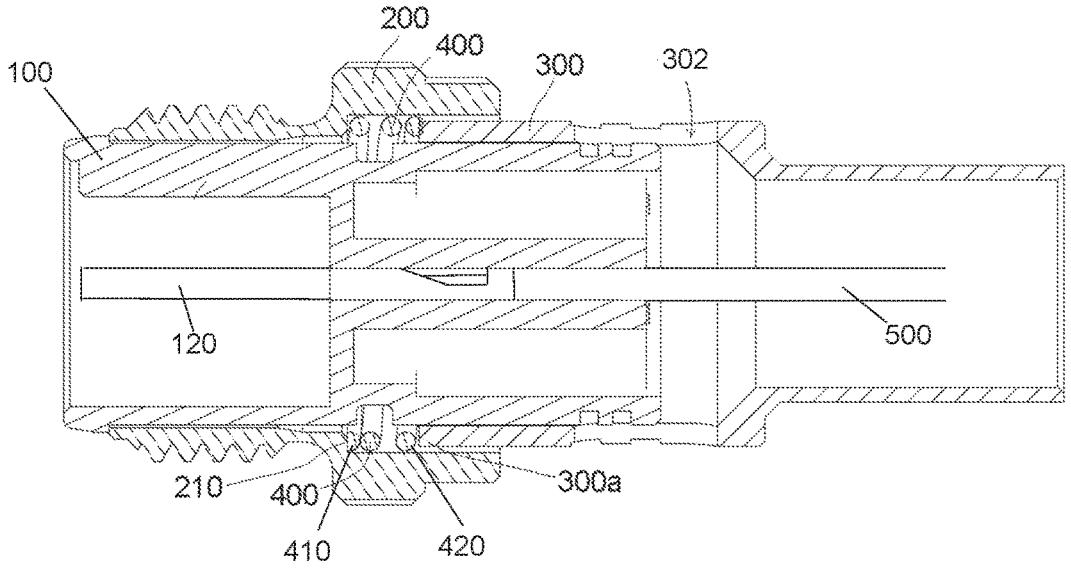
FIG. 2 is a sectional side view of the connector of FIG. 1.
Figure 3:
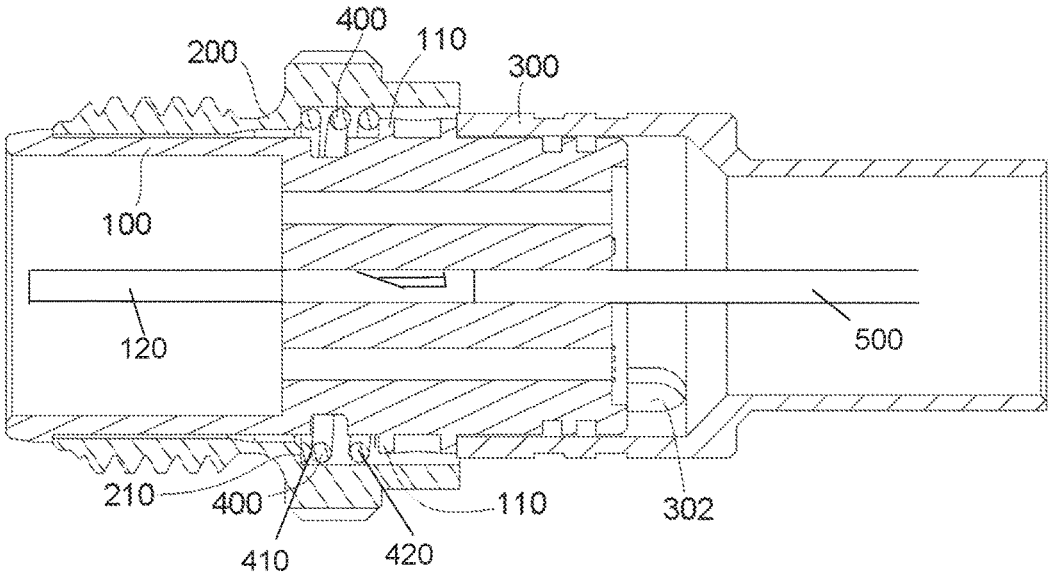
FIG. 3 is another sectional side view of the connector of FIG. 1.

An embodiment of a connector is show in FIGS. 1-3. The connector comprises a body 100, a conductive terminal 120, a shield housing 200, a shield tail cover 300, and a spring 400. The conductive terminal 120 is disposed in the body 100. The shield housing 200 is fitted over the body 100. In an embodiment, the body 100 is formed of an insulative material such as plastic and the shield housing 200 is formed of a metal material. In an embodiment, the connector is a cylindrical connector for use in an instrument, a controlling equipment, or any other type of electrical equipment known to those with ordinary skill in the art.

Figure 4:
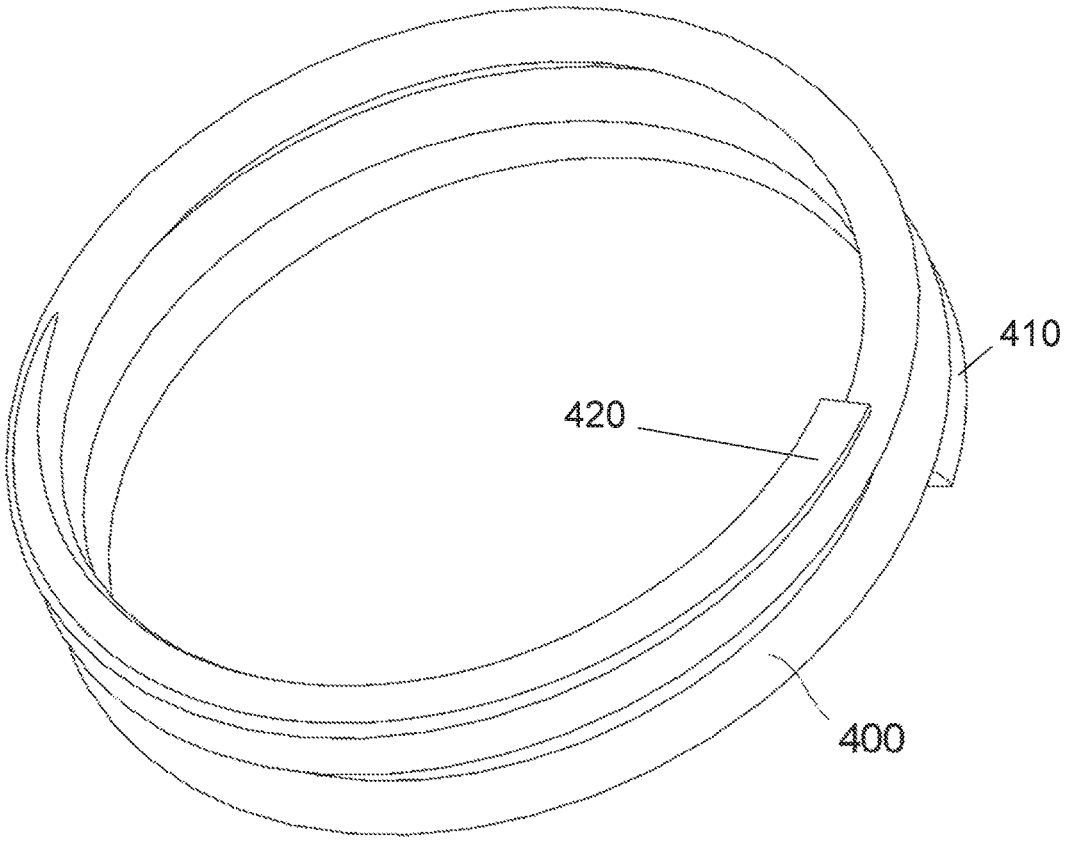
FIG. 4 is a perspective view of a spring of the connector of FIG. 1.
Figure 5:
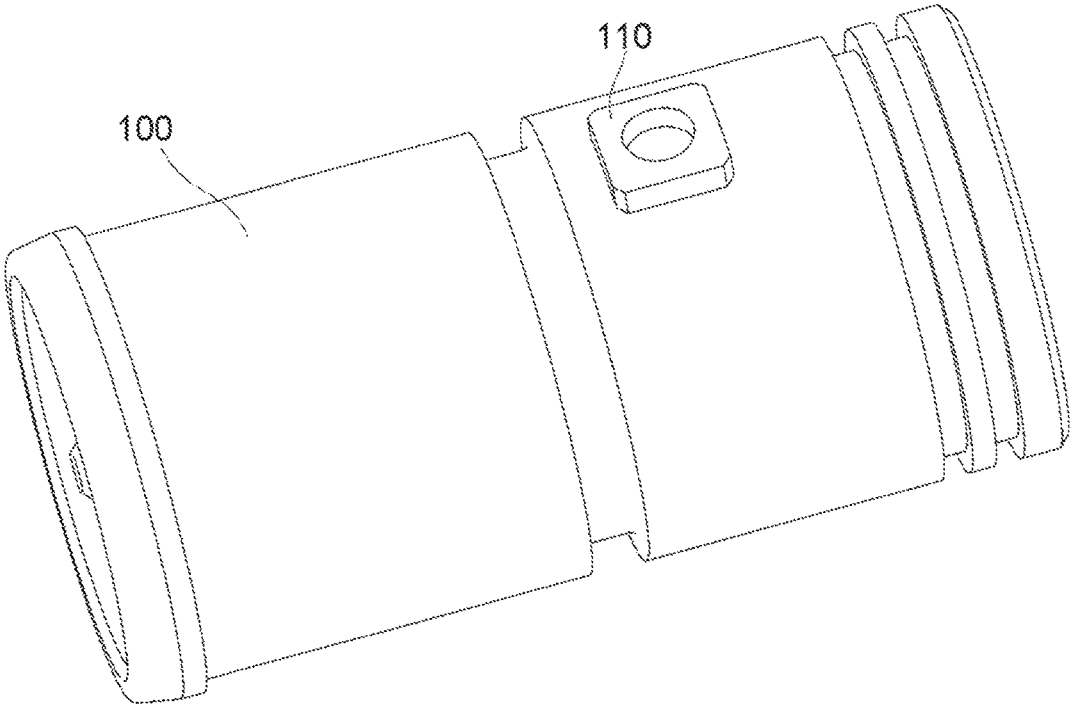
FIG. 5 is a perspective view of a body of the connector of FIG. 1.

The spring 400, as shown in FIGS. 3 and 4, is fitted over the body 100 and has a first end 410 and an opposite second end 420. The first end 410 of the spring 400 abuts against a first positioning structure formed on an inner wall of the shield housing 200. The second end 420 of the spring 400 abuts against a second positioning structure formed on an outer wall of the body 100. In the embodiment shown in FIGS. 3 and 5, the first positioning structure is a positioning step 210 formed on the inner wall of the shield housing 200 and the second positioning structure is a positioning protrusion 110 formed on an outer wall of the body 100. The spring 400 is positioned between the positioning step 210 and the positioning protrusion 110. The spring 400 is received in the shield housing 200 and is in electrical contact with the shield housing 200.

The spring 400 is capable of absorbing an external axial impact force acting on the shield housing 200, protecting the body 100 from being damaged and improving the anti-vibration performance of the connector. In addition, the spring 400 may also function as an electromagnetic shield, further improving electromagnetic shielding performance of the connector.

Figure 6:
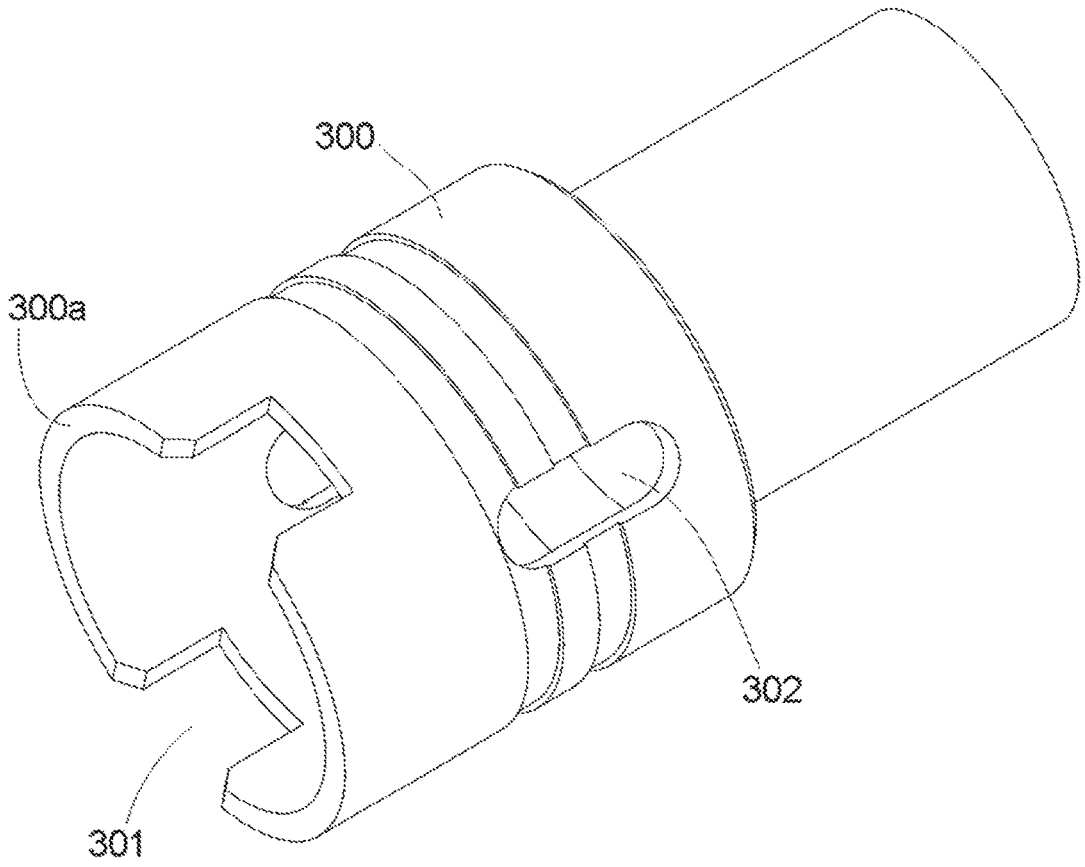
FIG. 6 is a perspective view of a shield tail cover of the connector of FIG. 1.

The shield tail cover 300 is shown in FIG. 6. The shield tail cover 300 has a receiving notch 301 disposed at a front end of the shield tail cover 300 having a front end surface 300*a*. In some embodiments, the front end surface 300*a* can act by itself as a second positioning structure or alternatively in conjunction with the positioning protrusion 110 of the body 100. The shield tail cover 300 also has a sealant injection passageway 302 extending through an approximate center of the shield tail cover 300. In an embodiment, the shield tail cover 300 is formed of a metal material.

The shield tail cover 300 is fitted over a rear end of the body 100, as shown in FIGS. 2 and 3. The receiving notch 301 is complementary to the positioning protrusion 110, and when the shield tail cover 300 is fitted over the body 100, the positioning protrusion 110 is received in the receiving notch 301. As shown in FIG. 2, when the shield tail cover 300 is fitted over the body 100, the second end 420 of the spring 400 simultaneously abuts against the positioning protrusion 110 of the body 100 and the front end surface 300*a* of the shield tail cover 300, and the first end 410 of the spring 400 abuts against the positioning step 210 of the shield housing 200. The spring 400 electrically connects the shield tail cover 300 to the shield housing 200.

The shield tail cover 300 is capable of providing electromagnetic shielding for an external wire electrically connected to the connector, thus further improving electromagnetic shielding performance of the connector. Further, the shield tail cover 300 is electrically connected to the shield housing 200 via the spring 400, so that the shield housing

200, the shield tail cover 300 and the spring 400 may function together as an electromagnetic shield, thereby further improving electromagnetic shielding performance of the connector.

A connector assembly according to an embodiment, as shown in FIGS. 2 and 3, comprises the connector and a wire 500 assembled with the connector. One end of the wire 500 passes through the shield tail cover 300 of the connector and is electrically connected to the conductive terminal 120 of the connector. The connector assembly further comprises a sealant injected through the sealant injection passageway 302 into the shield tail cover 300 and bonding the shield tail cover 300 to the body 100 and the wire 500.

In the shown embodiments, the positioning protrusion 110 is formed on the outer wall of the body 100 of the connector. In another embodiment, no positioning protrusion 110 is formed on the outer wall of the body 100 of the connector and the second end 420 of the spring 400 abuts only against a second positioning structure of the front end surface 300*a* of the shield tail cover 300.

In the shown embodiments, the shield tail cover 300 is fitted over the rear end of the body 100 of the connector. In another embodiment, the connector may not include the shield tail cover 300 and the second end 420 of the spring 400 abuts only against the positioning protrusion 110 of the body 100.

What is claimed is:

1. A connector, comprising:

a body;

a shield housing fitted over the body and having a first positioning structure formed on an inner wall of the shield housing;

a shield tail cover fitted over a rear end of the body and having a second positioning structure; and a spring disposed within the shield housing and fitted over the body, and having a first end abutting against the first positioning structure and an opposite second end abutting against the second positioning structure and electrically connecting the shield tail cover to the shield housing.

2. The connector of claim 1, wherein the first positioning structure is a positioning step.

3. The connector of claim 2, wherein the second positioning structure is a front end surface of the shield tail cover.

4. The connector of claim 1, wherein the body is formed of an insulative material.

5. The connector of claim 4, further comprising a conductive terminal disposed in the body.

6. A connector, comprising:

a shield housing positioned around an outermost surface of the connector and having a positioning step formed on an inner wall of the shield housing;

a body fitted under the shield housing and having a positioning protrusion formed on an outer wall of the body;

a spring disposed within the shield housing and fitted over the body and having a first end abutting against the positioning structure of the body and an opposite second end abutting against the positioning structure of the shield housing; and a shield tail cover fitted over a rear end of the body.

7. The connector of claim 6, wherein the shield tail cover has a receiving notch disposed at a front end complementary to the positioning protrusion.

8. The connector of claim 7, wherein the positioning protrusion is received in the receiving notch when the shield tail cover is fitted on the body.

9. The connector of claim 8, wherein the second end of the spring abuts against the positioning protrusion and a front end surface of the shield tail cover.

10. The connector of claim 9, wherein the spring electrically connects the shield tail cover and the shield housing.

11. The connector of claim 6, wherein the shield tail cover has a sealant injection passageway extending through the shield tail cover.

12. A connector assembly, comprising:

a connector including a shield housing having a positioning structure formed on an inner wall of the shield housing, and a body fitted under the shield housing and having a positioning structure formed on an outer wall of the body, a conductive terminal disposed in the body, and a spring disposed within the shield housing and fitted over the body and having a first end abutting against the positioning structure of the body and an opposite second end abutting against the positioning structure of the shield housing and a shield tail cover fitted over a rear end of the body having a sealant injection passageway and a sealant injected through the sealant injection passageway and into the shield tail cover; and a wire extending through the shield tail cover and electrically connected to the conductive terminal.

13. A connector assembly, comprising:

a connector including a shield housing having a positioning structure formed on an inner wall of the shield housing, and a body fitted under the shield housing and having a positioning structure formed on an outer wall of the body, a conductive terminal disposed in the body, and a spring disposed within the shield housing and fitted over the body and having a first end abutting against the positioning structure of the body and an opposite second end abutting against the positioning structure of the shield housing and a shield tail cover fitted over a rear end of the body; and a wire extending through the shield tail cover and electrically connected to the conductive terminal.

* * * * *